United States Patent [19]

Jacobs et al.

[11] 4,410,403

[45] Oct. 18, 1983

[54] ELECTROLYSIS METHOD

[75] Inventors: Stanley C. Jacobs, Lower Burrell; Raymond D. Wiltzius, New Kensington; John R. Minick, Leechburg; Perry A. Foster, Jr., New Kensington, all of Pa.

[73] Assignee: Aluminum Company of America, Pittsburgh, Pa.

[21] Appl. No.: 160,236

[22] Filed: Jun. 17, 1980

[51] Int. Cl.[3] ..... C25B 1/00; C25B 1/34; C25C 3/00; C25C 3/08

[52] U.S. Cl. ..... 204/67; 204/64 R; 204/98; 204/128; 204/243 R; 204/225; 204/250; 204/284; 204/219

[58] Field of Search ..... 204/67, 243 R, 98, 128, 204/64, 250, 219, 225, 284

[56] References Cited

U.S. PATENT DOCUMENTS

| | | | |
|---|---|---|---|
| 704,393 | 7/1902 | Simon | 204/64 R |
| 4,181,583 | 1/1980 | Steiger et al. | 204/243 R |
| 4,219,391 | 8/1980 | Foster | 204/67 |
| 4,231,853 | 11/1980 | Rahn | 204/243 R |

*Primary Examiner*—Howard S. Williams
*Attorney, Agent, or Firm*—Daniel A. Sullivan, Jr.

[57] ABSTRACT

An electrolysis method involving electrolyzing, between anodic and cathodic surface areas, a compound dissolved in a solvent. A liquid cathodic body is located in a region such that it is possible for waves in the body to touch anodic surface area. The improvement includes placing a bed of objects into the mentioned region. Interstices remain between the objects for accommodating liquid from the mentioned body.

7 Claims, 1 Drawing Figure

ELECTROLYSIS METHOD

BACKGROUND OF THE INVENTION

The present invention relates to electrolysis of a compound dissolved in a solvent using a liquid cathode, and, more particularly, to methods of producing molten aluminum by electrolysis of an aluminum compound dissolved in a solvent.

In efforts concerning the utilization of refractory hard metal elements for the production of aluminum according to U.S. Pat. No. 4,071,420, issued Jan. 31, 1978, in the names of P. A. Foster Jr. and S. C. Jacobs for "Electrolytic Production of Metal", a significant problem has been breakage of the elements. Substantial effort has been made to create refractory hard metal elements which are less susceptible to breakage. Efforts have also been made to reduce breakage by reducing the effects of thermal gradients during heatup; see, for example, U.S. Pat. No. 4,146,444, issued Mar. 27, 1979, in the name of J. R. Minick for "Method for Preheating a Molten Salt Electrolysis Cell".

SUMMARY OF THE INVENTION

An object of the invention is to reduce power consumption in electrolysis by quieting a liquid cathode such that anode-cathode separation can be minimized.

It is another object of the present invention to provide a method for the electrolytic production of molten metal, which method is less influenced by breakage of materials, for example refractory hard metals, in the region of electrolysis.

These as well as other objects which will become apparent in the discussion that follows are achieved according to the present invention by providing in an electrolysis method, including electrolyzing between anodic and cathodic surface areas, a compound dissolved in a solvent, wherein a liquid cathodic body is located in a region such that it is possible for waves in the body to touch anodic surface area, an improvement involving placing a bed of objects into the mentioned region, there being interstices between the objects for accommodating liquid of the mentioned body.

BRIEF DESCRIPTION OF THE DRAWING

The FIGURE is an elevational cross section of a cell utilizing an embodiment of methods according to the present invention.

DESCRIPTION OF THE PREFERRED EMBODIMENTS

Figure 1:
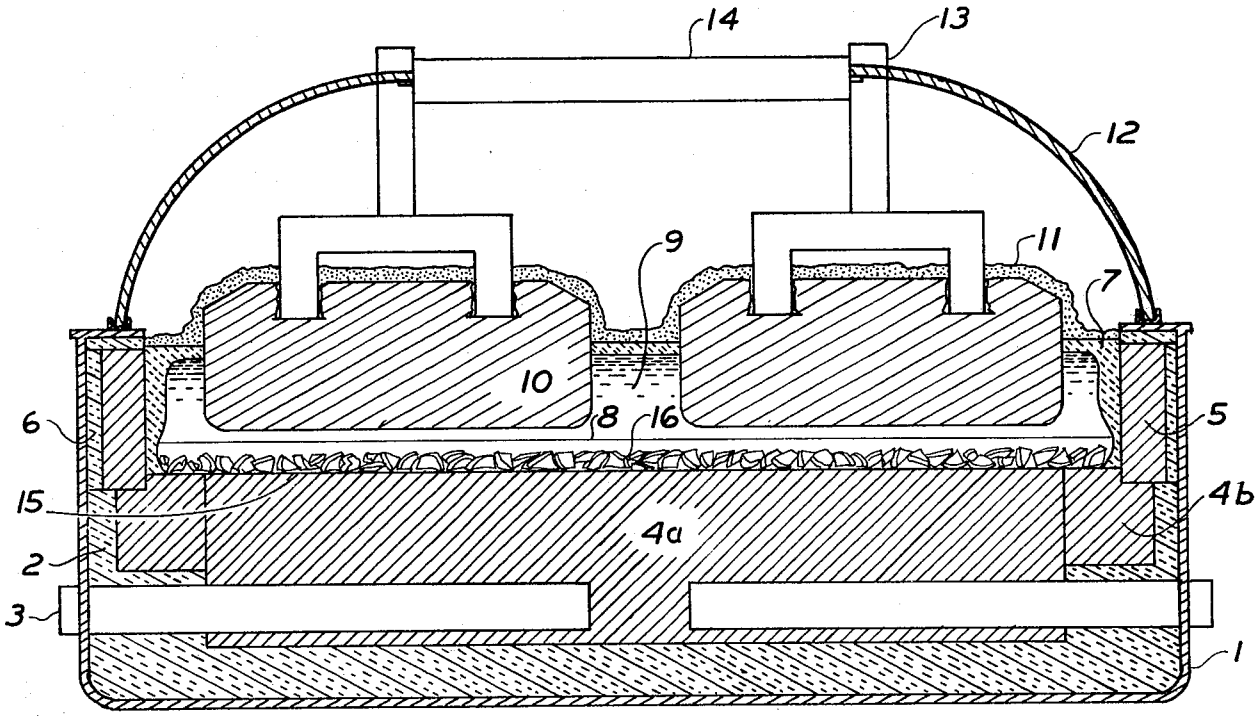

With reference to the FIGURE, there is illustrated a Hall-Heroult cell for producing aluminum, including as conventional features a steel shell 1, thermal insulation 2, electrical current collector bars 3, carbon lining **4*a*, 4*b*, carbon blocks 5, thermal insulation 6, frozen bath (or, more succinctly, "freeze") 7, molten aluminum 8, molten bath 9, carbon anodes 10, alumina 11, removable covers 12, anode rods 13, and superstructure 14. The foot portions of the covers 12** are provided with appropriate electrical barriers, so that the covers cannot act as a route for short-circuiting the electrical current around the electrolysis zone.

The molten bath 9 has a composition based on cryolite and acts as a solvent for the aluminum compound, alumina, to be electrolyzed. Alumina 11 is fed onto freeze 7 and is introduced from time to time into the bath 9 for dissolution therein by breaking-in the freeze

7, for example between the anodes. While cryolite basically makes up the bath, other compounds can be present, such as an extra (i.e., in addition to what is in the cryolite itself) amount of $AlF_3$; see, for example, U.S. Pat. No. 3,951,763, issued Apr. 20, 1976, in the names of W. C. Sleppy, C. N. Cochran, P. A. Foster Jr., and W. E. Haupin for "Aluminum Smelting Temperature Selection". Calcium fluoride is often found in the bath also.

Electrolysis takes place by virtue of direct current electrical power, the positive connection being to the anode rods, the negative connection being to the collector bars. Anodic surface area is provided by the portions of the anodes submerged in the molten bath, while cathodic surface area is provided by the molten aluminum 8, which is cathodic by virtue of its resting on the electrically conductive carbon lining **4*a* creating an electrical current flow path to the collector bars 3. It will be observed that the molten aluminum 8** represents a cathodic body of liquid occupying a region such that it is possible for waves in such body to touch anodic surface area. It can be sensed when waves are indeed touching anodic surface area; because when the anode is lowered too close to the molten aluminum, one begins to find erratic fluctuations in the measured electrical parameters (e.g. voltage) of the cell, and current efficiency, i.e. the percent of electrical current actually resulting in aluminum production, falls.

According to the invention there is placed on the floor 15 of the cell, in the region of the body of molten aluminum, a bed of objects 16 touching one another. Interstices between the objects accommodate molten aluminum. The bed exerts a damping effect on movement of molten aluminum and reduces wave amplitudes in the body.

In carrying out the present invention, the lower portion of the cell is constructed, and then objects, for example in the form of broken pieces of refractory hard metal, e.g., broken pieces of sintered $TiB_2$, are loaded onto the floor 15 and alternately tamped and screeded with a strike-off board to create a substantially level upper surface in the bed of pieces of refractory hard metal. This purposeful emplacement of the objects to form a bed is essentially different from the erratic, accidental and localized occurrence of broken pieces that can occur when members of an array of refractory hard metal elements such as in the above-mentioned U.S. Pat. No. 4,071,420 break down due to thermal shock, mechanical bumping, or other unintended happening. With a bed of objects, one achieves a well-balanced current distribution and a stable cell operation, as well as a uniform exertion of the damping effect of the objects on the molten metal to prevent waves and allow minimization of the separation of the anode from the effective cathode surface. The smaller such separation is, the lower the power consumption per pound of aluminum produced.

The lower portion of the cell is then brought into location in a line of cells using a crane and there placed beneath a superstructure 14. Anodes are mounted. The cell is brought to operating temperature by running electrical current from the anodes through resistor blocks extending from the floor to above the bed of objects 16. Examples of such resistor blocks are numbered "30" in the above-referenced U.S. Pat. No. 4,146,444. Following heatup, molten bath based on cryolite and containing dissolved alumina is introduced and electrolysis begun.

A preferred practice is to space the anodes initially a distance of 1/32 to 1¼ inches from the bed of objects 16. During electrolysis, molten aluminum forms on the bottom of the cell and builds up in the interstices of the objects 16. The aluminum eventually builds up to such an extent that it covers the highest tips of the objects in the bed. The aluminum may be allowed to build up even further, until the molten aluminum thickness above the bed becomes great enough that the wave amplitude reducing ability of the objects begins to be lost. Eventually a thickness will be reached where the objects are too far below the molten metal upper surface such that wave amplitudes in the upper surface of the metal become unacceptable in that the anodes must be backed off of the metal surface more than 1¼ inches resulting in unacceptable electrical power, or "$I^2R$", loss through the bath. Then, the cell is tapped by introduction of a suction tube down to, or even forced into, the broken pieces of refractory.

An example of operation parameters is to use a 2½-inch deep bed of objects of particle size passing through a 2½-inch screen and retained on a one-inch screen. Tapping is carried out when the molten metal has accumulated to a level 1 inch above the top of the bed. During tapping, the molten metal level is lowered until it comes to the top of the bed, i.e. tapping is terminated before the thickness of the molten metal becomes less than the thickness of the bed.

It is preferred that the objects placed on the floor of the cell be made of an electrically conductive, refractory material, like the refractory hard metals. These materials tend to be sufficiently refractory that they do not melt or dissolve under Hall-Heroult cell bath conditions. Their resistivity at cell temperature is of the same order of magnitude as that of molten aluminum. A suitable material is a sintered mixture of $TiB_2$ and BN manufactured as described in U.S. Pat. No. 4,097,567, issued June 27, 1978, in the names of W. S. Cebulak and J. D. Weyand for "Titanium Diboride Shapes". Almost any shape can be chosen; however, it is preferred to choose a shape which, when spread onto floor 15, will leave an appreciable volume of interstices for molten aluminum accommodation, balanced with an ability of the resulting bed to reduce waves in the molten aluminum body. A satisfactory refractory object is the pipe shape discussed in U.S. Pat. No. 4,097,567. Another example is the shards of those pipes which were broken in a U.S. Pat. No. 4,097,567 manufacturing process but which are otherwise sound (e.g. are well sintered and have the correct composition).

An advantage of the objects being electrically conductive is that a cell can be started without an initial charge of molten metal, without there being any adverse effect respecting $I^2R$ loss. In this case, the molten aluminum can even be tapped right down to the level of floor 15 at tapping time. Another option with electrically conductive objects is to control the tapping schedule such that the top of the bed is always above the molten aluminum; i.e. as the molten aluminum increases in thickness during electrolysis, tapping is initiated before its thickness exceeds the thickness of the bed. There is also an advantage in electrical conductivity in that current flow is constrained to a more vertical flow path, this meaning less magnetic pumping effects on the metal, i.e. less cause for there to be any waves in the metal that need damping out.

However, some of the advantages of the present invention are achieved just as well through the use of nonconducting objects. An example of such a material from the realm of electrical insulators would be suitably shaped alumina. In such an embodiment, it is preferred to donate an initial quantity of molten aluminum at the beginning of electrolysis to just cover the bed of objects and to tap after one additional inch of aluminum has accumulated; the tapping being controlled such that the metal level does not sink below the top of the bed of objects 16. Using such an initial charge of molten aluminum means that conductive material, i.e. molten aluminum, is always within a desired short distance from the anodes in order to minimize $I^2R$ losses in the bath.

In either of the embodiments, i.e. conductive objects or nonconductive objects, it may be beneficial to have candle leads (as discussed on page 498 of C. E. Ransley's article in Volume 2 of *Extractive Metallurgy of Aluminum,* Interscience Publishers, New York) buried in the objects to shunt any sludge interfering with current conduction at the bottom of the cell.

Common to both of the above-described embodiments of the present invention is the advantage that the pieces of material on the floor of the cell reduce wave amplitudes in the molten metal. This is an advantage because the resulting quiescent molten metal makes it possible to achieve reduced distance between the anodes and the effective cathode surface (molten metal surface, or molten metal surface and the object tips, when the objects are electrically conductive, depending on whether the molten metal is above or below the upper surface of the objects; or molten metal surface, when the objects are nonconductive), this meaning reduced electrical resistances losses, i.e. reduced electrical power consumption per pound of aluminum produced.

It will be understood that the above description of the present invention is susceptible to various modifications, changes, and adaptations, and the same are intended to be comprehended within the meaning and range of equivalents of the appended claims. For example, while a preferred embodiment of the invention relates to production of aluminum, it is clear that its broader aspects have application in such diverse areas as the production of NaOH and $Cl_2$ making use of electrolysis of NaCl dissolved in water above a liquid mercury cathode.

What is claimed is:

1. In an electrolysis method, including electrolyzing, between anodic and cathodic surface areas, a compound dissolved in a solvent, wherein a liquid cathodic body is located in a region such that it is possible for waves in the body to touch anodic surface area, the improvement comprising placing a bed of objects into said region, the objects touching one another in said body, there being interstices between the objects for accommodating liquid of said body.

2. A method as claimed in claim 1, wherein said compound is a compound of a metal, and said liquid cathodic body comprises said metal.

3. A method as claimed in claim 2, wherein said metal is aluminum.

4. A method as claimed in claim 3, wherein said compound is alumina.

5. A method as claimed in claim 1, wherein said objects are formed of electrically conductive material.

6. A method as claimed in claim 1, wherein the liquid cathodic body increases in thickness during electrolysis and is tapped when its thickness exceeds the thickness of the bed, tapping being terminated before the thickness of the liquid cathodic body becomes less than the thickness of the bed.

7. A method as claimed in claim 5, wherein the liquid cathodic body increases in thickness during electrolysis and is tapped before its thickness exceeds the thickness of the bed.

* * * * *